US006762783B1

(12) United States Patent
Gao et al.

(10) Patent No.: US 6,762,783 B1
(45) Date of Patent: Jul. 13, 2004

(54) PREVENTING CREASE FORMATION IN DONOR WEB IN DYE TRANSFER PRINTER THAT CAN CAUSE LINE ARTIFACT ON PRINT

(75) Inventors: Zhanjun J. Gao, Rochester, NY (US); John F. Corman, Rochester, NY (US); Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/392,502

(22) Filed: Mar. 20, 2003

(51) Int. Cl.[7] ..... B41J 17/28; B41J 17/30; B41J 35/08; B41J 35/04; B41J 35/06

(52) U.S. Cl. ..... 347/216; 400/234; 400/247; 400/248

(58) Field of Search ..... 347/217, 216; 400/234, 247, 248

(56) References Cited

U.S. PATENT DOCUMENTS 4,893,134 A * 1/1990 Yamamoto et al. ..... 400/248

FOREIGN PATENT DOCUMENTS

JP 08-230262 * 9/1996 ..... B41J/17/30

* cited by examiner

*Primary Examiner*—Huan Huu Tran
(74) *Attorney, Agent, or Firm*—Rogert A. Fields

(57) ABSTRACT

A thermal printer is adapted to prevent crease formation in a dye transfer area of a dye donor web that can cause line artifacts to be printed on a dye receiver during a dye transfer from the dye transfer area to the dye receiver in a dye transfer printer.

12 Claims, 11 Drawing Sheets

1

PREVENTING CREASE FORMATION IN DONOR WEB IN DYE TRANSFER PRINTER THAT CAN CAUSE LINE ARTIFACT ON PRINT

CROSS-REFERENCE TO RELATED APPLICATION

Cross-reference is made to commonly assigned, co-pending application Serial No. 10/394,888 entitled PREVENTING CREASE FORMATION IN DONOR WEB IN DYE TRANSFER PRINTER THAT CAN CAUSE LINE ARTIFACT ON PRINT, and filed Mar. 21, 2003 in the names of Zhanjun J. Gao, Po-Jen Shih and Robert F. Mindler.

FIELD OF THE INVENTION

The invention relates generally to dye transfer printers such as thermal printers, and in particular to the problem of crease or wrinkle formation in successive dye transfer areas of a dye donor web. Crease formation in the dye transfer area can result in an undesirable line artifact being printed on a dye receiver.

BACKGROUND OF THE INVENTION

A typical multi-color dye donor web that is used in a thermal printer is substantially thin and has a repeating series of three different rectangular-shaped color sections or patches such as a yellow color section, a magenta color section and a cyan color section. Also, there may be a transparent colorless laminating section immediately after the cyan color section.

Each color section of the dye donor web consists of a dye transfer area that is used for dye transfer printing and a pair of opposite longitudinal edge areas alongside the dye transfer area which are not used for printing. The dye transfer area is about 95% of the web width and the two edge areas are each about 2.5% of the web width.

To make a multi-color image print using a thermal printer, a motorized donor take-up spool pulls the dye donor web from a donor supply spool in order to successively draw an unused single series of yellow, magenta and cyan color sections over a stationary bead of selectively heated resistive elements on a thermal print head between the two spools. Respective color dyes within the yellow, magenta and cyan color sections are successively heat-transferred, via the bead of selectively heated resistive elements, in superimposed relation onto a dye receiver such as a paper or transparency sheet or roll, to form the color image print. The bead of resistive elements extends across the entire width of a color section, i.e. across its dye transfer area and the two edge areas alongside the transfer area. However, only those resistive elements that contact the dye transfer area are selectively heated. Those resistive elements that contact the two edge areas are not heated. In other words, the dye transfer is effected from the dye transfer area to the receiver medium, but not from the two edge areas to the receiver medium.

As each color section, including its dye transfer area and the two edge areas alongside the transfer area, is drawn over the bead of selectively heated resistive elements, the color section is subjected to a longitudinal tension particularly by a pulling force of the motorized donor take-up spool. Since the dye transfer area is heated by the resistive elements, but the two edge areas alongside the transfer area are not, the transfer area is significantly weakened and vulnerable to stretching as compared to the two edge areas. Consequently, the longitudinal tension will stretch the dye transfer area relative to the two edge areas. This stretching causes the dye transfer area to become thinner than the non-stretched edge areas, which in turn causes creases or wrinkles to develop in the transfer area, particularly diagonally across those regions of the transfer area that are close to the two edge areas. The creases or wrinkles are most notable in the regions of the dye transfer area that are close to the two edge areas because of the sharp, i.e. abrupt, transition between the weakened transfer area and the stronger edge areas, and they tend to be slanted diagonally across such regions.

As the dye donor web is pulled by the motorized donor take-up spool over the bead of selectively heated resistive elements, the creases or wrinkles tend to spread from a trailing or rear end portion of a used dye transfer area at least to a leading or front end portion of the next dye transfer area to be used. A problem that can result is that creases or wrinkles in the leading or front end portion of the next dye transfer area to be used will cause undesirable line artifacts to be printed on a leading or front end portion of the dye receiver, when the dye transfer occurs at the creases in the leading end portion of the next dye transfer area to be used. The line artifacts printed on the dye receiver are relatively short, but quite visible.

The question presented therefore is how to solve the problem of the creases or wrinkles being created in an unused transfer area so that no line artifacts are printed on the dye receiver during the dye transfer.

SUMMARY OF THE INVENTION

According to one aspect of the invention, there is provided a thermal printer capable of preventing crease formation in a dye transfer area of a dye donor web that can cause line artifacts to be printed on a dye receiver during a dye transfer from the dye transfer area to the dye receiver. The printer comprises:

- a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;
- a web take-up that takes up the dye donor web, and which exerts a pulling force on the dye transfer area and two edge areas at the print head that is sufficient to stretch the dye transfer area relative to the two edge areas to possibly form slanted creases in the dye transfer area diagonally extending at least across respective regions close to the two edge areas; and
- a web spreader adapted to spread the dye donor web diagonally across at least the regions in which slanted creases can form in order to oppose crease formation that can occur when the pulling force is exerted, whereby crease formation can at least be substantially prevented.

According to another aspect of the invention, there is provided a method of preventing crease formation in a dye transfer area of a dye donor web that can cause line artifacts to be printed on a dye receiver during a dye transfer from the dye transfer area to the dye receiver in a dye transfer printer. The method corresponds to operation of the thermal printer as described above.

DETAILED DESCRIPTION OF THE INVENTION

Donor Web

Figure 1:
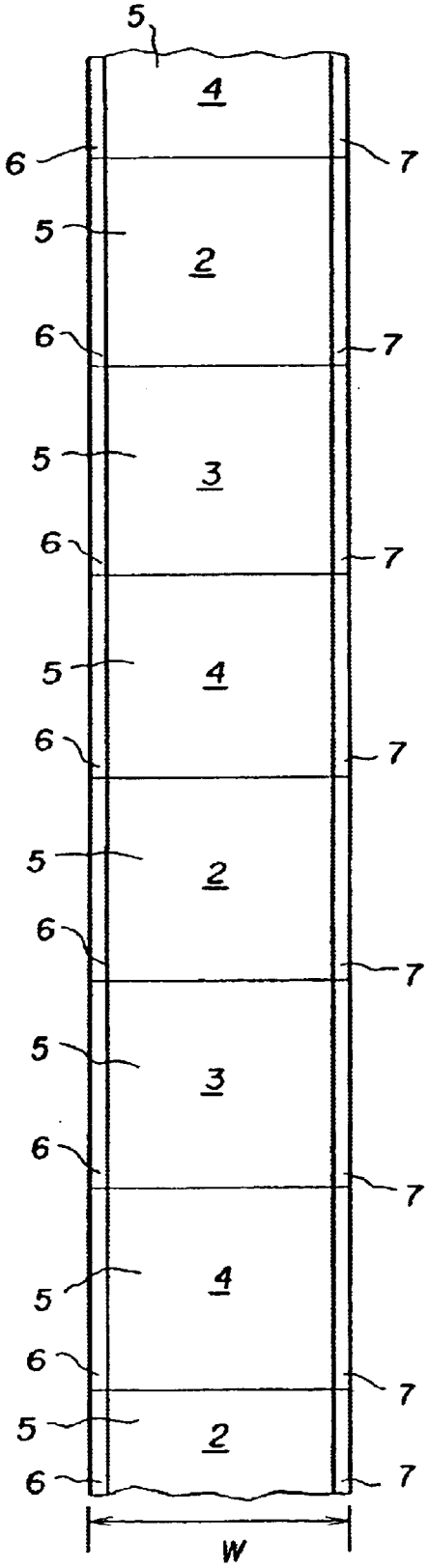
FIG. 1 is plan view of a typical dye donor web including successive dye transfer areas and opposite longitudinal edge areas alongside each one of the dye transfer areas.

FIG. 1 depicts a typical multi-color dye donor web or ink ribbon 1 that is used in a thermal printer. The dye donor web 1 is substantially thin and has a repeating series (only two completely shown) of three different rectangular-shaped color sections or patches such as a yellow color section 2, a magenta color section 3 and a cyan color section 4. Also, there may be a transparent laminating section (not shown) immediately after the cyan color section 4.

Each yellow, magenta or cyan color section 2, 3 and 4 of the dye donor web 1 consists of a yellow, magenta or cyan dye transfer area 5 that is used for printing and a pair of similar-colored opposite longitudinal edge areas 6 and 7 alongside the dye transfer area which are not used for printing. The dye transfer area 5 is about 95% of the web width W and the two edge areas 6 and 7 are each about 2.5% of the web width. See FIG. 1.

Dye Transfer Printer

FIGS. 2–6 depict operation of a thermal printer 10 using the dye donor web 1 to effect successive yellow, magenta and cyan dye transfers in superimposed relation onto a known dye receiver sheet 12 such as paper or a transparency.

Initialization

Figure 2:
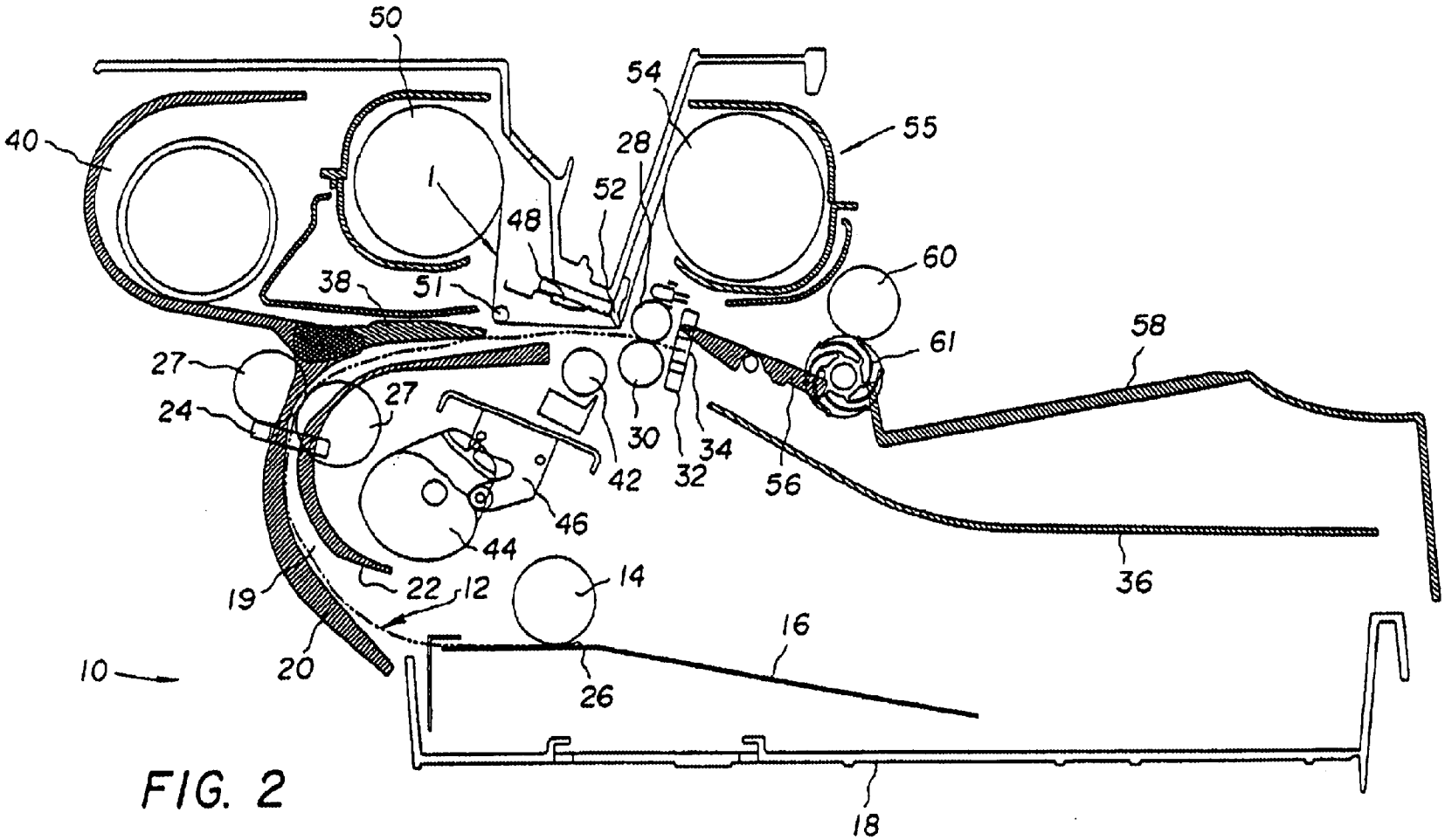
FIG. 2 is an elevation section view, partly in section, of a dye transfer printer, showing a beginning or initialization cycle during a printer operation.

Beginning with FIG. 2, the dye receiver sheet 12 is initially advanced forward via motorized coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing or rear edge 26 of the receiver sheet 12, it activates at least one of pair of motorized parallel-axis urge rollers 27, 27 in the channel 19. The activated rollers 27, 27 advance the receiver sheet 12 forward (to the right in FIG. 2) through the nip of a motorized capstan roller 28 and a pinch roller 30, positioned beyond the channel 19, and to a leading (front) edge sensor 32.

Figure 3:
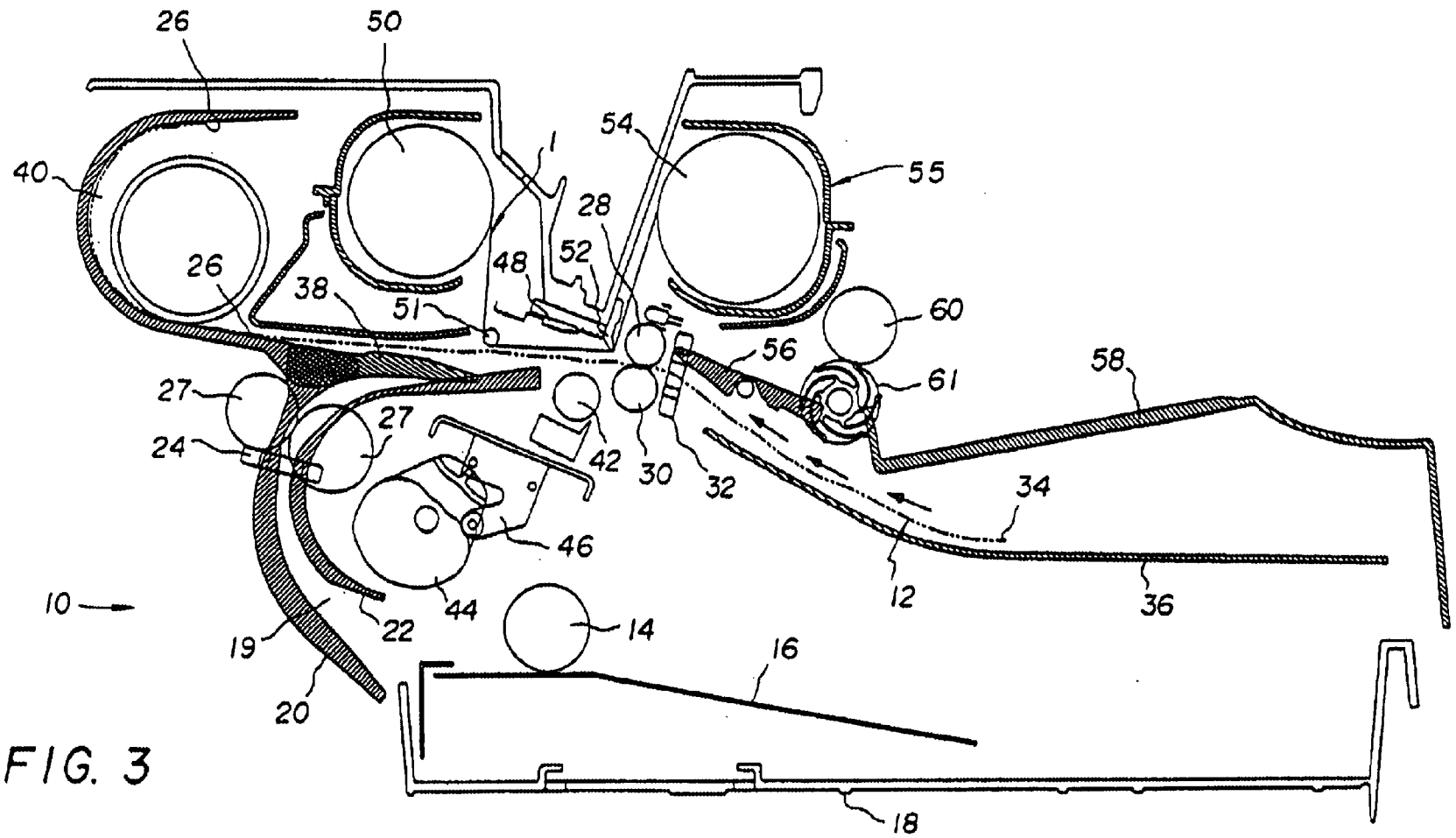
FIGS. 3 and 4 are elevation section views of the dye transfer printer as in FIG. 2, showing successive dye transfer cycles during the printer operation.

In FIG. 3, the leading edge sensor 32 has sensed a leading or front edge 34 of the dye receiver sheet 12 and activated the motorized capstan roller 28 to cause that roller and the pinch roller 30 to advance the receiver sheet forward partially onto an intermediate tray 36. The receiver sheet 12 is advanced forward onto the intermediate tray 36 so that the trailing or rear edge 26 of the receiver sheet can be moved beyond a hinged exit door 38 which is a longitudinal extension of the curved guide 20. Then, as illustrated, the hinged exit door 38 closes and the capstan and pinch rollers 28 and 30 are reversed to advance the receiver sheet 12 rearward, i.e. rear edge 26 first, partially into a rewind chamber 40.

Successive Yellow, Magenta and Cyan Dye Transfers

To make a multi-color image print, respective color dyes in the dye transfer areas 5 of a single series of yellow, magenta and cyan color sections 2, 3 and 4 on the dye donor web 1 must be successively heat-transferred in superimposed relation onto the dye receiver sheet 12. This is shown beginning in FIG. 4.

Figure 4:
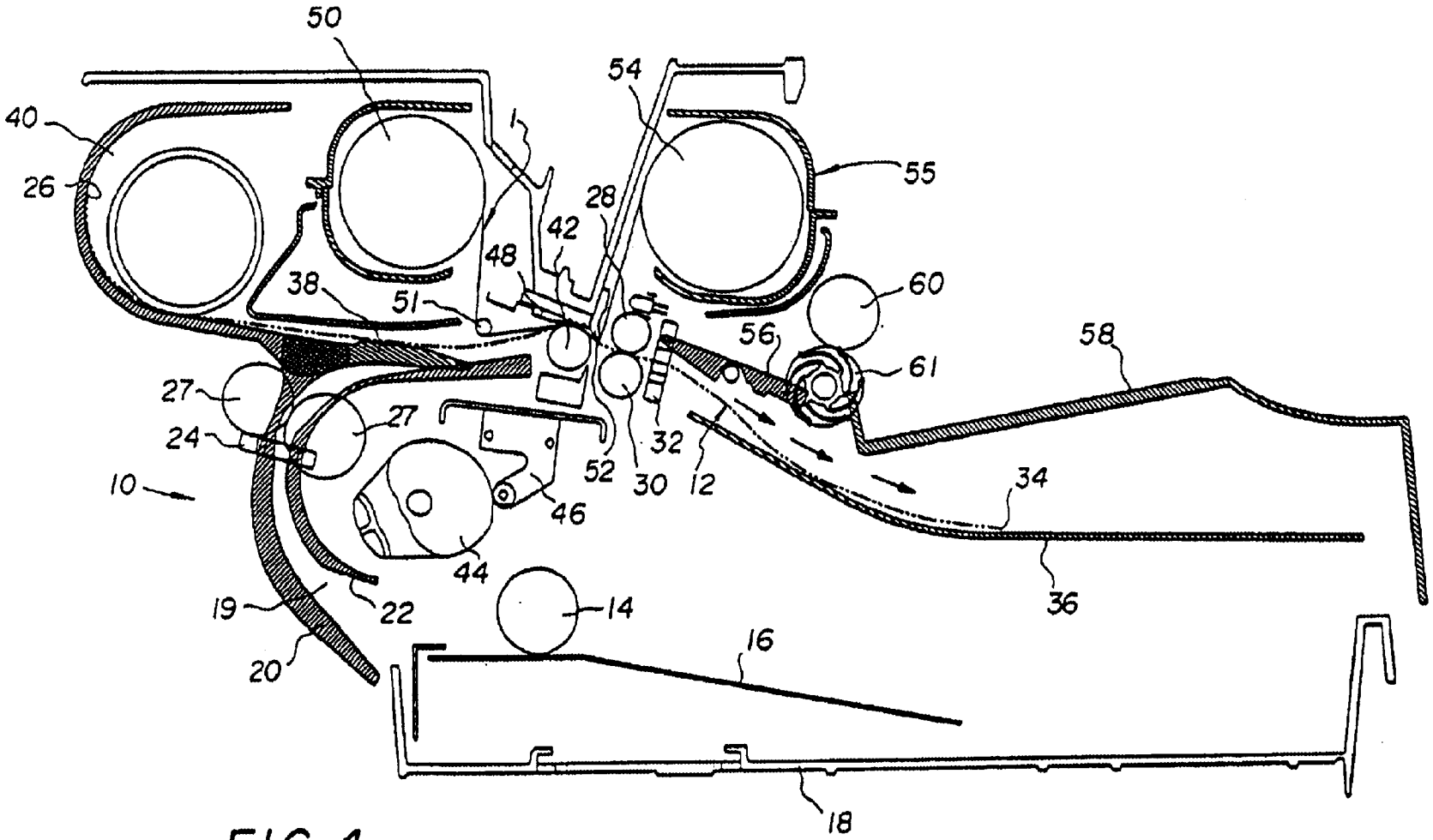

In FIG. 4, a platen roller 42 is shifted via a rotated cam 44 and a platen lift 46 to adjacent a thermal print head 48. This causes the dye receiver sheet 12 and an unused (fresh) yellow color section 2 of the dye donor web 1 to be locally held together between the platen roller 42 and the print head 48. The motorized capstan roller 28 and the pinch roller 30 are reversed to again advance the dye receiver sheet 12 forward to begin to return the receiver sheet to the intermediate tray 36. At the same time, the dye donor web 1 is moved forward from a donor web supply spool 50, over a stationary donor web guide bar 51, the print head 48, and a stationary donor web guide nose 52. This is accomplished by a motorized donor web take-up spool 54 that incrementally (progressively) pulls or draws the dye donor web forward. The donor web supply and take-up spools 50 and 54 together with the dye donor web 1 may be provided in a replaceable cartridge 55 that is manually loaded into the printer 10.

Figure 7:
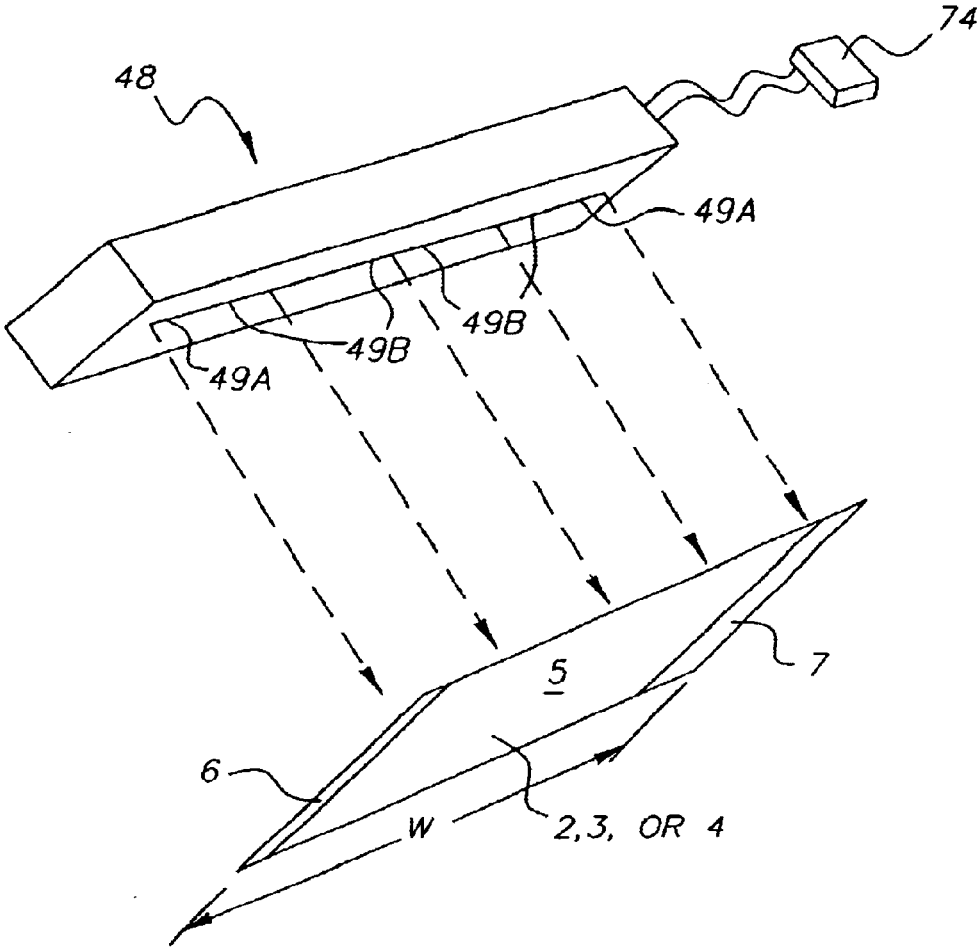
FIG. 7 is a perspective view of a bead of selectively heated resistive elements on a print head in the dye transfer printer.

When the yellow color section 2 of the dye donor web 1 is pulled forward over the print head 48 in FIG. 4, the yellow color dye in the dye transfer area 5 of that color section is heat-transferred onto the dye receiver sheet 12. The yellow color dye in the two edge areas 6 and 7 of the yellow color section 2, which are alongside the dye transfer area 5, is not heat-transferred onto the dye receiver sheet 12. In this connection, the print head 48 has a bead of selectively heated, closely spaced, resistive elements 49A, 49A, . . . , 49B, 49B, . . . , 49A, 49A, . . . on the print head 48 that make contact across the entire width W of the yellow color section 2, i.e. across its dye transfer area 5 and the two edge areas 6 and 7 alongside the transfer area. As shown in FIG. 7, the resistive elements 49A make contact with the edge areas 6 and 7 and the resistive elements 49B make contact with the dye transfer area 5. However, only the resistive elements 49B are selectively heated sufficiently to effect the yellow dye transfer from the dye transfer area 5 to the dye receiver sheet 12. The yellow dye transfer is done line-by-line, i.e. row-by-row, widthwise across the dye transfer area 5. The resistive elements 49A are not heated (or only slightly heated) so that there is no yellow dye transfer from the edge areas 6 and 7 to the dye receiver sheet 12.

Figure 5:
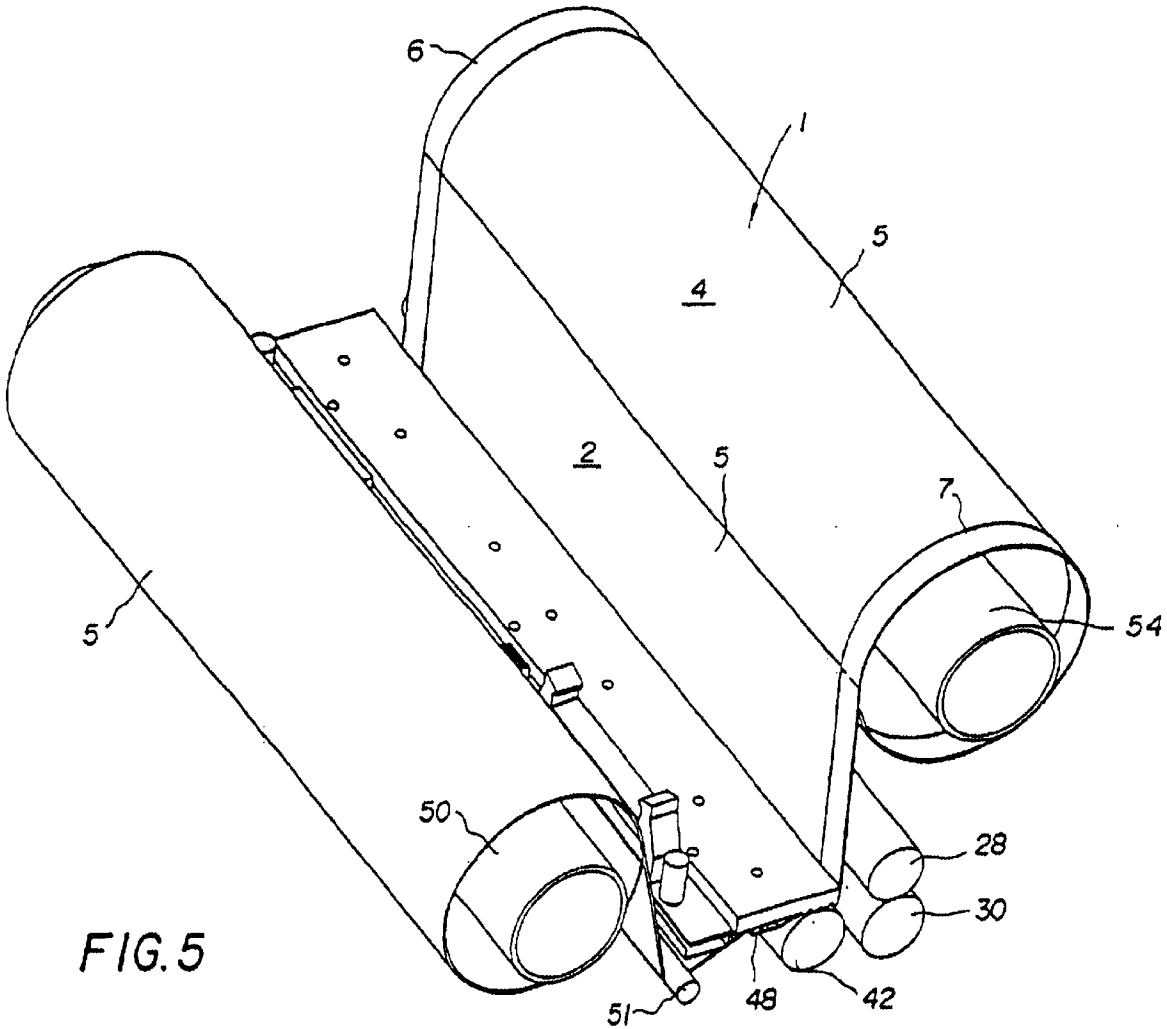
FIG. 5 is perspective view of a printing or dye transfer station in the dye transfer printer.

As the yellow color section 2 of the dye donor web 1 is used for dye transfer line-by-line, it is pulled forward from the print head 48 and over the guide nose 52 in FIGS. 4 and 5. Then, once the yellow dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet 12 rearward, i.e. trailing or rear edge 26 first, partially into the rewind chamber 40. See FIG. 3.

Then, the dye transfer onto the dye receiver sheet 12 is repeated line-by-line in FIG. 4, but this time using an unused (fresh) magenta color section 3 of the dye donor web 1 to heat-transfer the magenta color dye from the dye transfer area 5 of that color section onto the dye receiver sheet. The magenta dye transfer is superimposed on the yellow dye transfer on the dye receiver sheet 12.

Once the magenta dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing or rear edge 26 first, partially into the rewind chamber 40. See FIG. 3.

Then, the dye transfer onto the dye receiver sheet 12 is repeated line-by-line in FIG. 4, but this time using an unused (fresh) cyan color section 3 of the dye donor web 1 to heat-transfer the cyan color dye from the dye transfer area 5 of that color section onto the dye receiver sheet. The cyan dye transfer is superimposed on the magenta and yellow dye transfers on the dye receiver sheet 12.

Figure 6:
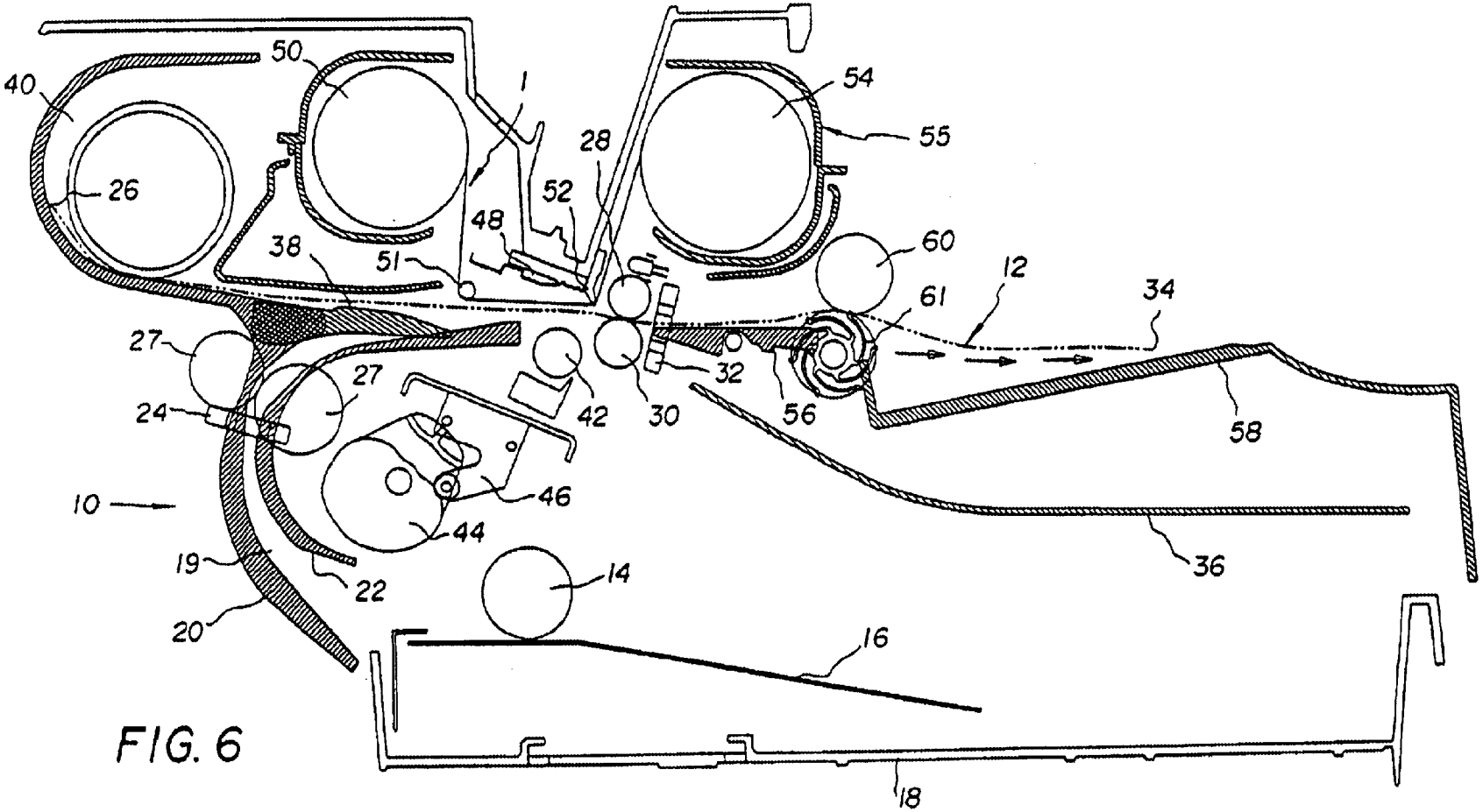
FIG. 6 is an elevation section view of the dye transfer printer as in FIG. 2, showing a final cycle during the printer operation.

Once the cyan dye transfer onto the dye receiver sheet 12 is completed, the platen roller 42 is shifted via the rotated cam 44 and the platen lift 46 from adjacent the print head 48 to separate the platen roller from the print head, and the motorized capstan roller 28 and the pinch roller 30 are reversed to advance the dye receiver sheet rearward, i.e. trailing or rear edge 26 first, partially into the rewind chamber 40. See FIG. 3. Final Finally, as shown in FIG. 6, the platen roller 42 remains separated from the print head 48 and the motorized capstan roller 28 and the pinch roller 30 are reversed to advance the dye receiver sheet 12 forward. However, in this instance a diverter 56 is pivoted to divert the dye receiver sheet 12 to an exit tray 58 instead of returning the receiver sheet to the intermediate tray 36 as in FIG. 4. A pair of parallel axis exit rollers 60 and 61 aid in advancing the receiver sheet 12 into the exit tray 58.

Prior Art Problem

Figure 8:
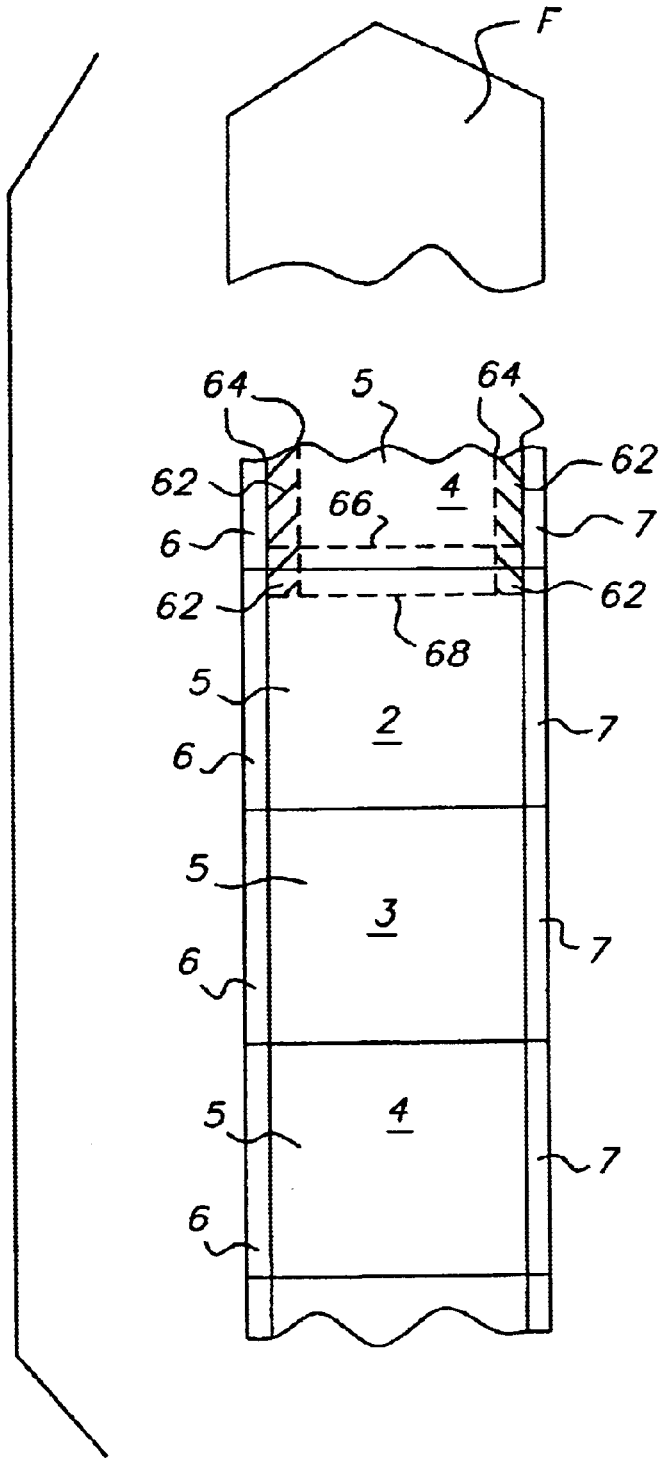
FIG. 8 (PRIOR ART)
FIG. 8 is a plan view of a portion of the donor web as in FIG. 1, showing slanted creases or wrinkles spreading rearward from a trailing or rear end portion of a used transfer area into a leading or front end portion of an unused transfer area in the next (fresh) color section to be used, as in the prior art.

Typically in prior art dye transfer, as each yellow, magenta and cyan color section 2, 3 and 4, including its dye transfer area 5 and the two edge areas 6 and 7 alongside the transfer area, is pulled or drawn forward over the bead of selectively heated resistive elements 49A, 49A, . . . , 49B, 49B, . . . , 49A, 49A, . . . , the color section is subjected to a longitudinal tension imposed substantially by a uniform or substantially uniform pulling force F of the motorized donor web take-up spool 54. See FIG. 8. Moreover, since the dye transfer area 5 is heated by the resistive elements 49B, but the two edge areas 6 and 7 alongside the transfer area are not heated by the resistive elements 49A, the dye transfer area is significantly weakened in relation to the two edge areas and therefore becomes more susceptible or vulnerable to being stretched than the edge areas. See FIG. 7. Consequently, the longitudinal tension imposed by the pulling force F of the motorized take-up spool 54 will stretch the dye transfer area 5 relative to the two edge areas 6 and 7. This stretching causes the dye transfer area 5 to become thinner than the non-stretched edge areas 6 and 7, which in turn causes slanted creases or wrinkles 62 to develop in the dye transfer area, particularly across those regions 64 of the transfer area that are close to the two edge areas. See FIGS. 8 and 13. The slanted creases or wrinkles 62 are most notable in the regions 64 of the dye transfer area 5 that are close to the two edge areas 6 and 7 because of the sharp, i.e. abrupt, transition between the weakened transfer area and the stronger edge areas, and they are inclined at an approximately 450 acute angle a from each edge area 6 or 7 as shown in FIGS. 8. and 13 to diagonally extend forward at least within each region 64.

Figure 9:
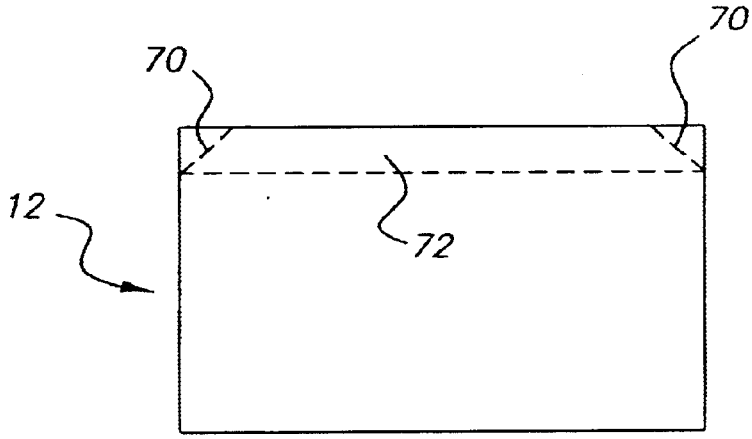
FIG. 9 (PRIOR ART)
FIG. 9 is a plan view of a dye receiver sheet, showing line artifacts printed on a leading or front edge portion of the dye receiver sheet, as in the prior art.

As the dye donor web 1 is pulled by the motorized donor take-up spool 54 over the bead of selectively heated resistive elements 49A, 49A, . . . , 49B, 49B, . . . , 49A, 49A, . . . , the slanted creases or wrinkles 62 tend to spread rearward from a trailing or rear end portion 66 of a used dye transfer area 5 at least to a leading or front end portion 68 of the next dye transfer area to be used. See FIG. 8. A problem that can result is that slanted creases or wrinkles 62 in the leading or front end portion 68 of the next dye transfer area 5 to be used will cause undesirable line artifacts 70 to be printed on a leading or front end portion 72 of the dye receiver sheet 12, when the dye transfer occurs at the creases in the leading end portion of the next transfer area to be used. See FIG. 9. The line artifacts 70 printed on the dye receiver sheet 12 are relatively short, but quite visible.

The question presented therefore is how to solve the problem of the slanted creases or wrinkles 62 being created in an unused transfer area 5 so that no line artifacts 70 are printed on the dye receiver sheet 12 during the dye transfer.

Solution (FIGS. 10–13)

As previously mentioned, during successive yellow, magenta and cyan dye transfers onto the dye receiver sheet 12 in the thermal printer 10, the resistive elements 49B make contact across the dye transfer area 5 and the resistive elements 49A make contact across the two edge areas 6 and 7 alongside the dye transfer area. See FIG. 7. However, only the resistive elements 49B are selectively heated sufficiently to effect the dye transfers. Thus, the dye transfer area 5 becomes more susceptible or vulnerable to being stretched than the two edge areas 5 and 6 alongside the dye transfer area.

A known heat activating control 74, preferably including a suitably programmed microcomputer using known programming techniques, is connected individually to the resistive elements 49A, 49A, . . . ,49B, 49B, . . . , 49A, 49A, . . . , to selectively heat those resistive elements 49B that make contact with the dye transfer area 5, and preferably not heat those resistive elements 49A that make contact with the two edge areas 6 and 7 alongside the dye transfer area. See FIG. 7.

The stationary donor web guide bar 51 in the printer 10, shown in FIGS. 2–6, is cylindrical in shape and therefore has a constant diameter. As such, it is substantially ineffective to prevent the slanted creases 62 from forming in the regions 64 of the dye transfer area 5 that are close to the two edge areas 6 and 7. See FIG. 8.

Accordingly, there has been devised a pair of donor web spreading members 76 and 78 to be used in place of the cylindrical bar 51. By contrast, the donor web spreading members 76 and 78 prevent the slanted creases 62 from forming in the regions 64 of the dye transfer area 5 that are close to the two edge areas 6 and 7. See FIG. 10.

Figure 10:
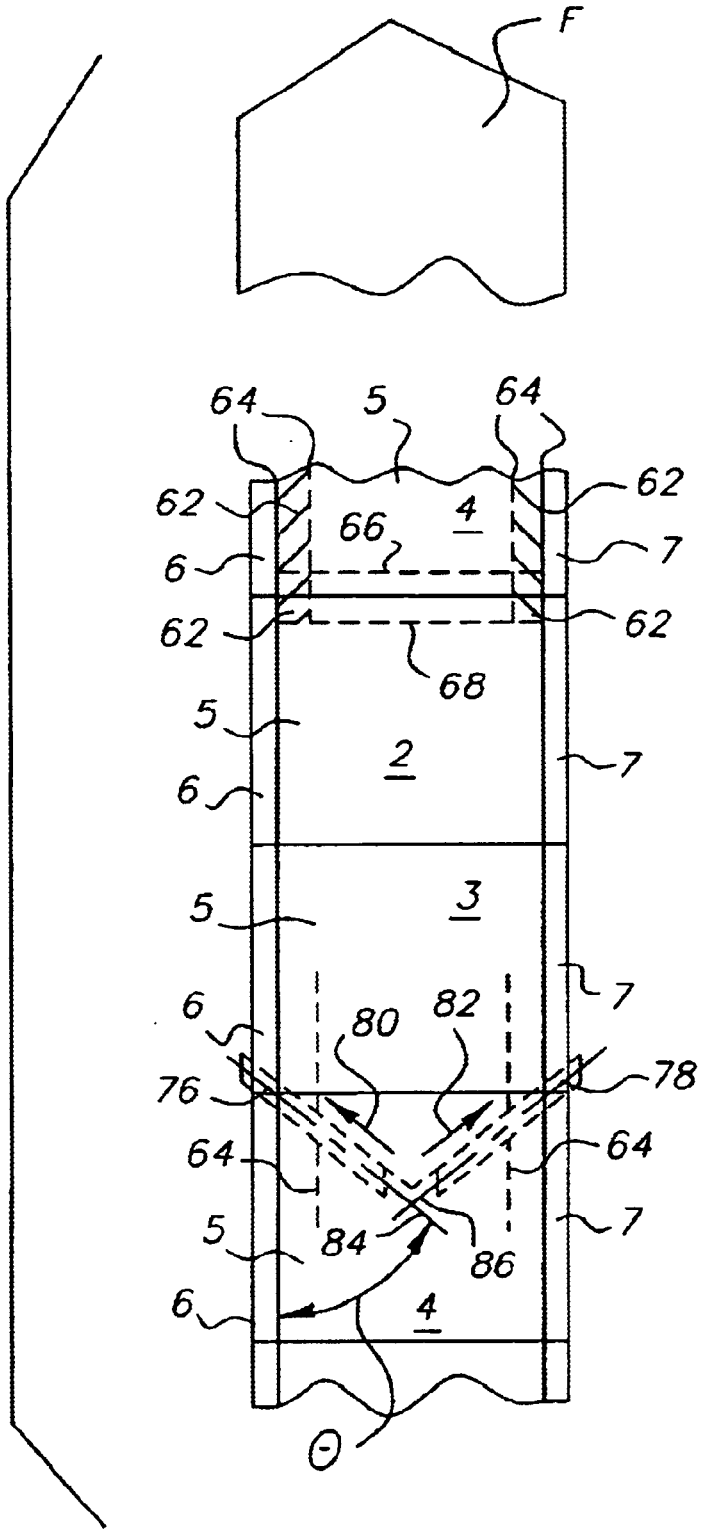
FIG. 10 is a plan view of the dye donor web and of a pair of web spreading members according to a preferred embodiment of the invention.
Figure 13:
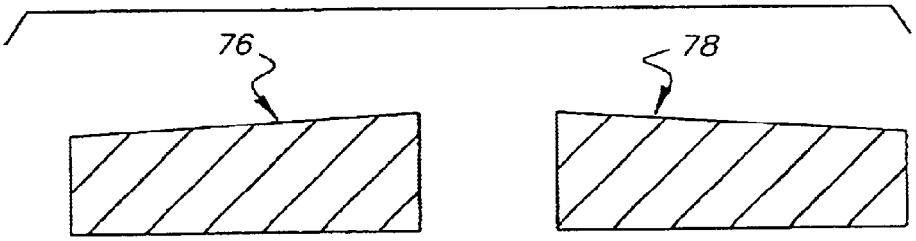
FIG. 13 is a cross-section view of a pair of web spreading members according to an alternate embodiment of the invention.

The pair of donor web spreading members 76 and 78 are mounted in the printer 10, preferably between the donor web supply spool 50 and the print head 48, to be positioned diagonally across at least the regions 64 in which the slanted creases 62 can form, in order to spread the dye donor web 1 in respective spreading directions 80 and 82 diagonally across at least the regions. The web spreading directions 80 and 82 oppose or counteract, preferably substantially perpendicularly, the possibility of crease formation in the regions 64 as shown in FIGS. 10 and 13. In FIGS. 10 and 13, the donor web spreading members 76 and 78 are inclined preferably at an approximately 45° acute angle θ from each edge area 6 or 7 to diagonally extend forward at least within each region 64. However, the acute angle θ can be varied 45°+/−30°, i.e. between 15° and 75°.

Figure 11:
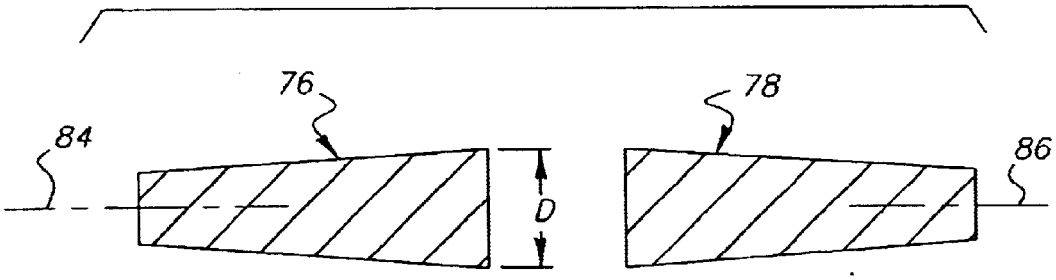
FIG. 11 is a cross-section view of the web spreading members according to the preferred embodiment.
Figure 12:
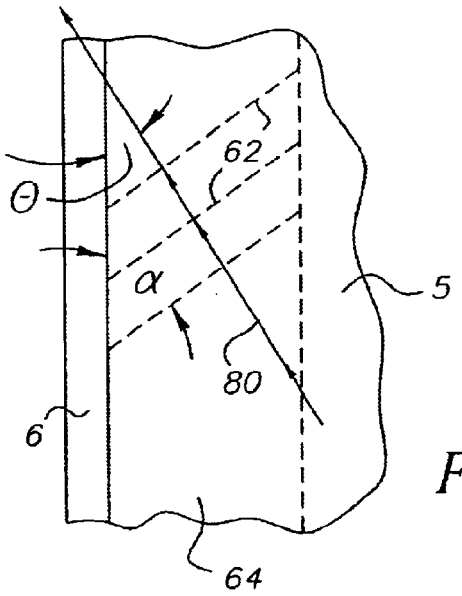
FIG. 12 is a schematic view depicting operation of one of the web spreading members.

Preferably, the donor web spreading members 76 and 78 are independently rotatable about respective intersecting axes 84 and 86 as shown in FIGS. 10 and 11, and they are conical-like in shape to gradually diminish in diameter D diagonally across at least the regions 64 in which the slanted creases 62 can form. Alternatively, as shown in FIG. 12 the web spreading members 76 and 78 are immobile and gradually incline diagonally to gradually diminish in diameter D. In either instance, the donor web spreading members 76 and 78 are shaped to bow the dye donor web 1 diagonally across at least the regions 64 in which the slanted creases 62 can form, to spread the dye donor web in the web spreading directions 80 and 82. This web spreading has sufficient force to counteract or prevent formation of the slanted creases 64.

FIG. 14

Figure 14:
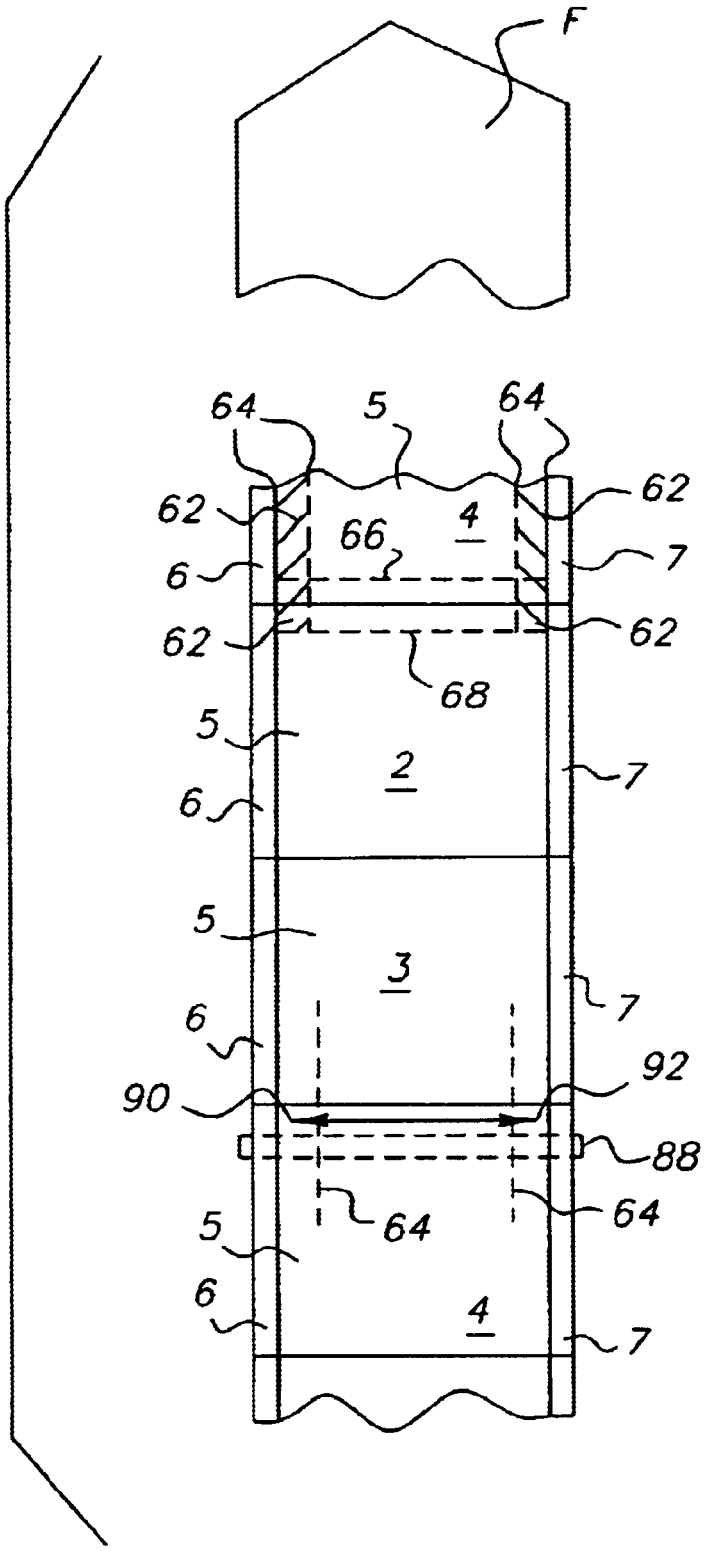
FIG. 14 is a plan view of the dye donor web and of a single-piece web spreading member that operates less effectively than the preferred and alternate embodiment pair of web spreading member in FIGS. 10–13.

FIG. 14 shows a single web spreading member 88 that operates less effectively than the preferred and alternate embodiments of the pair of web spreading members 84 and 86 shown in FIGS. 10–13. The single-piece web spreading member 88 could be mounted in the printer 10, between the donor web supply spool 50 and the print head 48, to be stationary or rotatable. It gradually diminishes in diameter from a longitudinal center to opposite ends, so that the dye donor web 1 would be spread in respective opposite spreading directions 90 and 92 perpendicularly across at least each region 64 in which the slanted creases 62 can form.

The invention has been described in detail with particular reference to certain preferred embodiments thereof, but it will be understood that variations and modifications can be effected within the spirit and scope of the invention.

PARTS LIST

1. donor web
2. cyan color section
3. magenta color section
4. yellow color section
5. dye transfer area
6. longitudinal edge area
7. longitudinal edge area
W. web width
10. thermal dye transfer printer
12. dye receiver sheet
14. pick rollers
16. platen
18. tray
19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller
44. cam
46. platen lift
48. thermal print head
49A, 49B. resistive elements
50. donor web supply spool
51. donor web guide web bar
52. donor web guide nose
54. donor web take-up spool
55. cartridge
56. diverter
58. exit tray
60. exit roller
61. exit roller
F. pulling force
62. slanted creases or wrinkles
64. regions
α. acute angle
66. trailing or rear end portion
68. leading or front end portion
70. line artifacts
72. leading or front end portion
74. heat activating control
76. donor web spreading member
78. donor web spreading member
80. donor web spreading direction
82. donor web spreading direction
θ. acute angle
84. axis
86. axis
D. diameter
88. single-piece donor web spreading member
90. donor web spreading direction
92. donor web spreading direction

What is claimed is:

1. A thermal printer capable of preventing crease formation in a dye transfer area of a dye donor web that can cause line artifacts to be printed on a dye receiver during a dye transfer from the dye transfer area to the dye receiver, said printer comprising:

a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

a web take-up that takes up the dye donor web, and which exerts a pulling force on the dye transfer area and two edge areas at said print head that is sufficient to form slanted creases in the dye transfer area diagonally extending at least across respective regions close to the two edge areas; and a web spreader adapted to spread the dye donor web diagonally across at least the regions in which slanted creases can form in order to oppose crease formation that can occur when the pulling force is exerted, whereby crease formation can at least be substantially prevented.

2. A thermal printer as recited in claim 1 wherein said web spreader is located between said print head and a web supply for the dye donor web.

3. A thermal printer as recited in claim 1, wherein said web spreader includes respective web spreading members mounted to be positioned diagonally across at least the regions in which slanted creases can form.

4. A thermal printer as recited in claim 3, wherein said web spreading members are independently rotatable about respective intersecting axes.

5. A thermal printer as recited in claim 4, wherein said web spreading members are conical-like in shape to gradually diminish in diameter diagonally across at least the regions in which slanted creases can form.

6. A thermal printer as recited in claim 3, wherein said web spreading members are immobile and gradually incline diagonally across at least the regions in which slanted creases can form.

7. A thermal printer capable of preventing crease formation in a dye transfer area of a dye donor web that can cause line artifacts to be printed on a dye receiver during a dye transfer from the dye transfer area to the dye receiver, said printer comprising:

a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

a web take-up that takes up the dye donor web, and which exerts a pulling force on the dye transfer area and two edge areas at said print head that is sufficient to stretch the dye transfer area relative to the two edge areas to possibly form slanted creases in the dye transfer area diagonally extending at least across respective regions close to the two edge areas; and means for spreading the dye donor web diagonally across at least the regions in which slanted creases can form to oppose crease formation that can occur when the pulling force is exerted, whereby crease formation can at least substantially prevented.

8. A thermal printer as recited in claim 7, wherein said means for spreading includes respective web spreading members mounted to be positioned diagonally across at least the regions in which slanted creases can form and at similar acute angles of 45°+/−30° with respect to the two edge areas alongside the dye transfer area.

9. A thermal printer as recited in claim 7, wherein said means for spreading includes respective web spreading members mounted to be positioned diagonally across at least the regions in which slanted creases can form and shaped to bow the dye donor web diagonally across at least said regions in order to spread the dye donor web diagonally across at least said regions.

10. A thermal printer capable of preventing crease formation in a dye transfer area of a dye donor web that can cause line artifacts to be printed on a dye receiver during a dye transfer from the dye transfer area to the dye receiver, said printer comprising:

a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

a web take-up that takes up the dye donor web, and which exerts a pulling force on the dye transfer area and two edge areas at said print head that is sufficient to stretch the dye transfer area relative to the two edge areas to possibly form slanted creases in the dye transfer area diagonally extending at least across respective regions close to the two edge areas; and a pair of web spreading members located between said print head and a web supply for the dye donor web, and mounted to be positioned diagonally across at least the regions in which slanted creases can form in order to spread the dye donor web in respective directions diagonally across at least said regions to substantially perpendicularly oppose crease formation in said regions that can occur when the pulling force is exerted, whereby crease formation can at least be substantially prevented.

11. A method of preventing crease formation in a dye transfer area of a dye donor web that can cause line artifacts to be printed on a dye receiver during a dye transfer from the dye transfer area to the dye receiver in a dye transfer printer, said method comprising:

heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver;

taking up the dye donor web, but exerting a pulling force on the dye transfer area and two edge areas that is sufficient to form slanted creases in the dye transfer area diagonally extending at least across respective regions close to the two edge areas so that the dye transfer area is vulnerable to being stretched relative to the two edge areas; and spreading the dye donor web diagonally across at least the regions in which slanted creases can form in order to oppose crease formation that can occur when the pulling force is exerted, whereby crease formation can at least be substantially prevented.

12. A method of preventing crease formation in a dye transfer area of a dye donor web that can cause line artifacts to be printed on a dye receiver during a dye transfer from the dye transfer area to the dye receiver in a dye transfer printer, said method comprising:

heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver so that the dye transfer area is vulnerable to being stretched relative to the two edge areas;

taking up the dye donor web, but exerting a pulling force on the dye transfer area and two edge areas that is sufficient to stretch the dye transfer area relative to the two edge areas to possibly form slanted creases in the dye transfer area diagonally extending at least across respective regions close to the two edge areas; and between the print head and a web supply for the dye donor web, spreading the dye donor web in respective directions diagonally across at least the regions in which slanted creases can form in order to substantially perpendicularly oppose or counteract crease formation in the regions that can occur when the pulling force is exerted, whereby crease formation can at least be substantially prevented.

* * * * *